United States Patent [19]

Baldwin

[11] 4,000,923

[45] Jan. 4, 1977

[54] GABION BASKET EMPLACEMENT APPARATUS AND METHOD

[76] Inventor: Matt Baldwin, 127 N. Milroy, Olympia, Wash. 98502

[22] Filed: June 26, 1975

[21] Appl. No.: 590,461

[52] U.S. Cl. ..... 294/67 AB

[51] Int. Cl. ..... B66c 1/38

[58] Field of Search ..... 294/67 AB, 63 R; 214/658, 152

[56] References Cited

UNITED STATES PATENTS 3,039,810 6/1962 Bellingher et al. ..... 294/67 AB

*Primary Examiner*—Stanley H. Tollberg

*Attorney, Agent, or Firm*—Christensen, O'Connor, Garrison & Havelka

[57] ABSTRACT

A lift-fork type carriage means capable of lifting, carrying and emplacing filled gabion baskets into position in a revetment mattress lining a stream bed or other erosion prone area to control water erosion. The gabion basket handling device is characterized by a plurality of lift-fork tines adapted to engage the under-surface of a filled gabion basket, a plurality of hold-down arms rotatable into contact with the top and one side of the filled gabion basket by linkage means actuated upon application of lifting forces to the apparatus. The hold-down arm linkage is counterbalanced so that lifting forces applied to the apparatus when empty are insufficient to rotate the hold-down arms into a closed position.

15 Claims, 4 Drawing Figures

GABION BASKET EMPLACEMENT APPARATUS AND METHOD

BACKGROUND OF THE INVENTION

This invention is directed to an apparatus and method for emplacing filled gabion baskets in a revetment mattress. Heretofore emplacement of gabion baskets was accomplished by moving the empty wire-framed gabion basket into its position adjacent other previously emplaced gabion baskets, wiring the basket to the adjacent baskets, filling the basket by placing rocks of various sizes therein and closing the basket so as to form a secure layer of rocks bounded by wire mesh at a location in a stream, canal, or the like where erosion from water flow is anticipated. The transportation of the rocks necessary and the difficulty of getting the rocks from a road bed upon which a vehicle can travel to the gabion baskets in a stream bed made the emplacement of gabion baskets by the prior art method an extremely laborious and time consuming process as well as involving substantial expense for the handwork and labor necessary to place the baskets.

Prior art devices for utility carriage of various objects suffer from the inability to angle the bottom of the device as is necessary to emplace a filled gabion basket in a stream bed or the like or have been found to be unduly complicated in their mechanical structure in requiring a plurality of hydraulic or other operating mechanisms and the like to accomplish the necessary lifting, grasping, and holding of the gabion baskets. For example, U.S. Pat. No. 3,817,567 shows a utility carriage for mobile loaders having a plurality of hydraulic cylinders as the actuating means for the hold-down fingers shown therein. No provision is made for usage of this device with a single lifting cable such as a crane or a line attached to a backhoe. As a consequence of the hydraulic actuating mechanism, single line operation is not possible. In U.S. Pat. No. 3,863,971 an adjustable support for a material handling fork is shown in order to balance the fork when handling various loads. Again, control mechanisms and complex equipment is necessary to accomplish the goals of the apparatus set forth therein.

SUMMARY OF THE INVENTION

The present invention is an apparatus for emplacing filled gabion baskets in a revetment mattress and further a method of forming a revetment mattress using filled gabion baskets. The apparatus comprises a lift-fork type device operable from a single lift cable. A frame carries a set of rigidly attached fork tines adapted to slide underneath a filled gabion basket on a specially constructed pallet and one or more sets of rotatively mounted hold-down arms actuated by lifting forces imposed upon the apparatus. The hold-down arms rotate into engagement with a filled gabion basket to prevent the gabion basket from sliding off the fork tines when held at an attitude approximating the slope of the stream bed into which the gabion basket is to be placed. The hold-down arms are counterbalanced against rotation in the absence of the weight provided by the filled gabion baskets so that the apparatus may be transported with the hold-down arms in the open position whenever the apparatus is empty. The apparatus is equipped with two lift points, the first being the main lift for carrying and transporting the apparatus in either the filled gabion basket carrying mode or empty and the secondary lift means adapted to remove the apparatus from engagement with the gabion basket whenever the filled gabion basket has been emplaced in its operative location in the stream bed. Lift on the secondary lift means causes the fork tines to be withdrawn from underneath the emplaced gabion basket.

The method of this invention comprises filling gabion baskets upon a flat surface having specially constructed pallets thereon or otherwise equipped to permit insertion of the arms of a gabion basket lift apparatus directly underneath the lower surface of the gabion basket. The filled gabion baskets, containing rocks or other objects are wired shut and transported to a position adjacent the stream bed in which a revetment mattress is to be formed from gabion baskets. The gabion basket lift apparatus described herein is inserted beneath the gabion basket, the hold-down arms are rotated into engagement with the top and outer edge of the gabion basket and the entire apparatus lifted by use of a single lift line. Upon placing tension on the lift line the apparatus assumes an attitude approximating the slope of the stream bed in which the revetment mattress is being placed. The gabion basket lift apparatus containing the filled gabion basket is then moved into position such as by rotation of the crane apparatus or other lift equipment utilized and transported to the position at which the basket is desired. The equipment is lowered until the main lift line is slack, and the hold-down arms are rotated out of contact with the gabion basket. The secondary lift means is then utilized to withdraw the gabion basket lift device from engagement with the gabion basket. The basket is then wired to adjacent gabion baskets to form the revetment mattress and the process repeated until the necessary number of gabion baskets are emplaced.

OBJECTS OF THE INVENTION

It is one object of this invention to provide apparatus for lifting, transporting, and emplacing filled gabion baskets in a revetment mattress.

It is a second object of this invention to provide a method of forming revetment mattresses from gabion baskets wherein the baskets are filled prior to emplacement thereof in the stream bed.

It is a further object of this invention to provide gabion basket emplacement apparatus which may operate on a single lift line such as by a crane or by attachment of a single line to the bucket of a backhoe and which transports the filled gabion baskets from their rest position on a truck or other transport means to the revetment mattress area inclined at an angle approximating the slope of the stream bed in which the revetment mattress is being formed.

These and other objects and advantages of this invention will become readily apparent to one of skill in this art upon a detailed examination of the appended drawings and study of the description thereof which follows.

DETAILED DESCRIPTION OF THE PREFERRED EMBODIMENT

Figure 1:
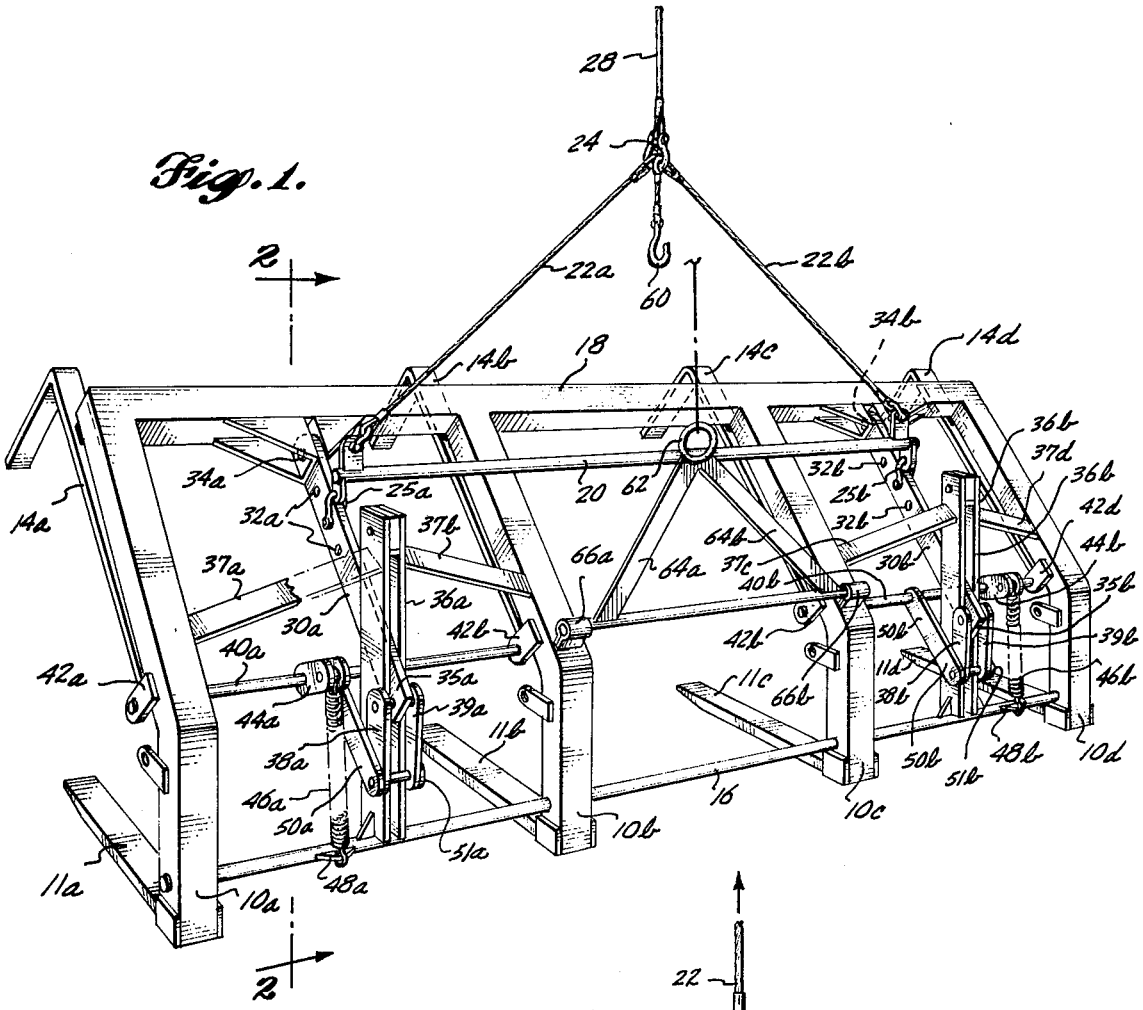
FIG. 1 is a rear prospective view of the apparatus of this invention.

Referring specifically to the drawings wherein like numerals indicate like parts, there is seen in FIG. 1 a gabion basket lift apparatus in which a plurality of fork lift tines 11*a* through 11*d* are shown attached to the bottom terminal portions of vertical frame elements 10*a* through 10*d*. The frame elements are also connected together by crossbeam 16 at the lower end thereof and extend upwardly to a second crossmember 18 which comprises a boxbeam extending across the full length of the apparatus. Each vertical frame member 10*a* through 10*d* is securely welded to boxbeam 18 and to crossmember 16 to form a rigid lifting apparatus. Fork tines 11*a* through 11*d* are chosen in length to accomodate the width of a gabion basket. The gabion basket such as that shown in FIG. 2 comprises a wire mesh basket which is filled with stones of varying diameters in the range of a minimum of about 2 inches to a maximum of 12 to 15 inches with the normal run being 6 to 10 inches in diameter.

Hold-down arms 14*a* through 14*d* are adapted to rotate into contact with the upper surface and one edge of the gabion basket. The terminal end of arm 14 is bent downwardly to prevent the gabion basket from slipping off the end of the fork tines when the apparatus is inclined. The inboard end of arms 14*a* through 14*d* are respectively pivotally mounted at arm pivot bearings 42*a* through 42*d* on rear frame members 10*a* through 10*d* respectively. In the embodiment shown, hold-down arms 14*a* and 14*b* pivot as a unit within arm pivot bearings 42*a* and 42*b* whereas the hold-down arms 14*c* and 14*d* pivot as a unit in arm pivot bearings 42*c* and 42*d*.

Figure 2:
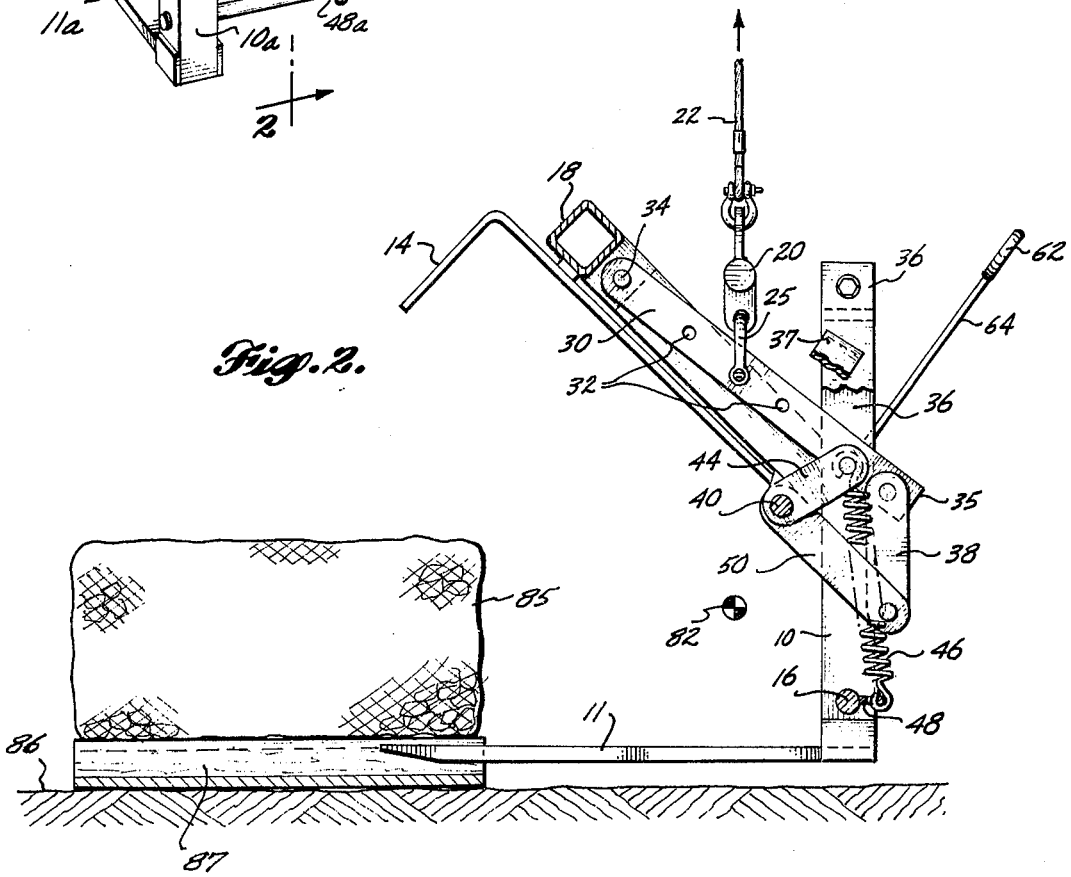
FIG. 2 is a side elevational view of the apparatus shown in FIG. 1.
Figure 4:
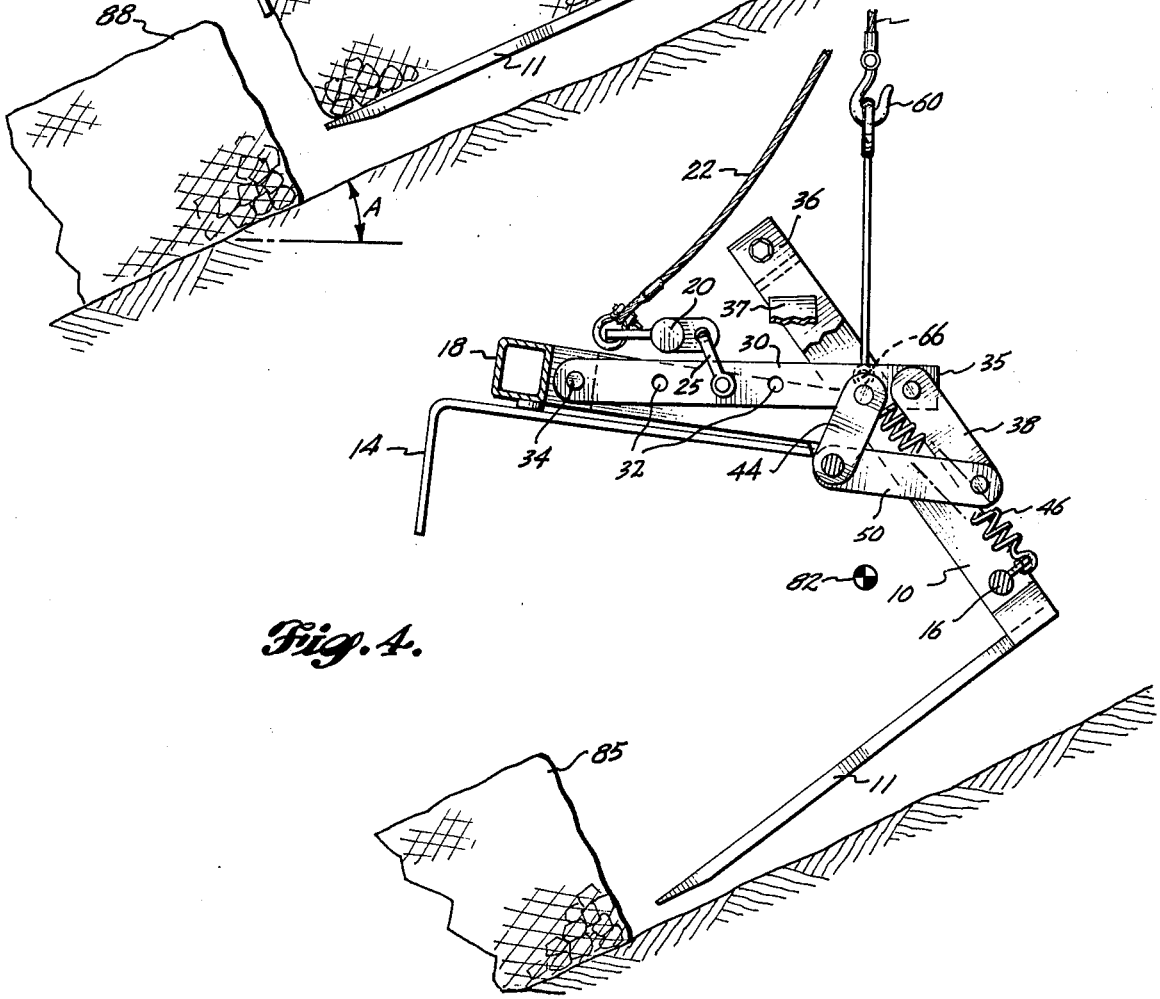
FIG. 4 is a side elevational view of the apparatus shown in FIG. 1 wherein the secondary lift means is being utilized to remove the apparatus from contact with the filled gabion basket.

Arms 14*a* through 14*d* are actuated by a linkage mechanism operated by the main lift cable 28. This mechanism has a counterbalance in the form of springs 46*a* and 46*b* which act to hold the hold-down arms 14*a* through 14*d* in the open position as shown in FIGS. 1, 2 and 4. The main lift line 28 engages a pair of straddle cables 22*a* and 22*b* which in turn are connected to lift beam 20 which acts to hold the straddled cables 22*a* and 22*b* in the position shown in FIG. 1. The lift beam 20 is connected by means of a pair of clevis elements 25 and 26 to lever arms 30*a* and 30*b*. Lever arms 30*a* and 30*b* constitute levers of the third class having a fulcrum at pivot 34*a* and 34*b* respectively, lift effort at the joint between lift beam 20 and lever arms 30*a* and 30*b* and a load or weight at the ends 35*a* and 35*b* respectively. A pair of links 38*a* and 39*a* are pivotally attached to the end 35*a* of lever arm 30*a*. The links 38*a* and 39*a* are in turn pivotally attached to the end of crank arms 50*a* and 51*a* with pin 52. Crank arms 50*a* and 51*a* are mounted on arm pivot beam 40*a* and upon application of force from lever arm 30*a* causes rotation of arm pivot beam 40*a* about arm pivot bearings 42*a* and 42*b*. In turn, arm pivot beam 40*a* causes hold-down arms 14*a* and 14*b* to pivot downwardly since they are rigidly attached to arm pivot beam 40*a*. Also attached to arm pivot beam 40*a* is a spring shackle means 44*a* onto which is mounted a tension spring 46*a* which extends from spring shackle 44*a* to lower spring shackle 48*a* mounted on crossbeam 16. Spring 46*a* urges arm pivot beam 40*a* in a clockwise direction when viewed from the near side of the apparatus shown in FIG. 1 thus causing hold-down arms 14*a* and 14*b* to assume the position shown in FIG. 1. Spring 46*a* is of such strength as to prevent the rotation downwardly of arms 14*a* and 14*b* when the apparatus is raised without a gabion basket resting on fork tines 11, but readily permits the hold-down arms 14*a* and 14*b* to rotate downwardly when the apparatus is lifted with a gabion basket resting on the fork tines 11*a* through 11*d*.

In their travel up and down, lever arms 30*a* and 30*b* are restrained from side-to-side movement by guide members 36*a* and 36*b* comprising a pair of spaced apart, substantially vertical members attached at their lower end to crossbeam 16 and held in position at their upper end by braces 37*a* and 37*b*. Similarly, lever arm 30*b* is guided by guide means 36*b* which also is held in position by attachment to crossbeam 16 at its lower end and braced by braces 37*c* and 37*d* at its upper end.

Arms 14*c* and 14*d* are operated by a linkage identical to that described above for arms 14*a* and 14*b*. Thus, two independently operated sets of hold-down arms are described, each being independently rotatable by lifting forces applied to lift cable 28.

Figure 3:
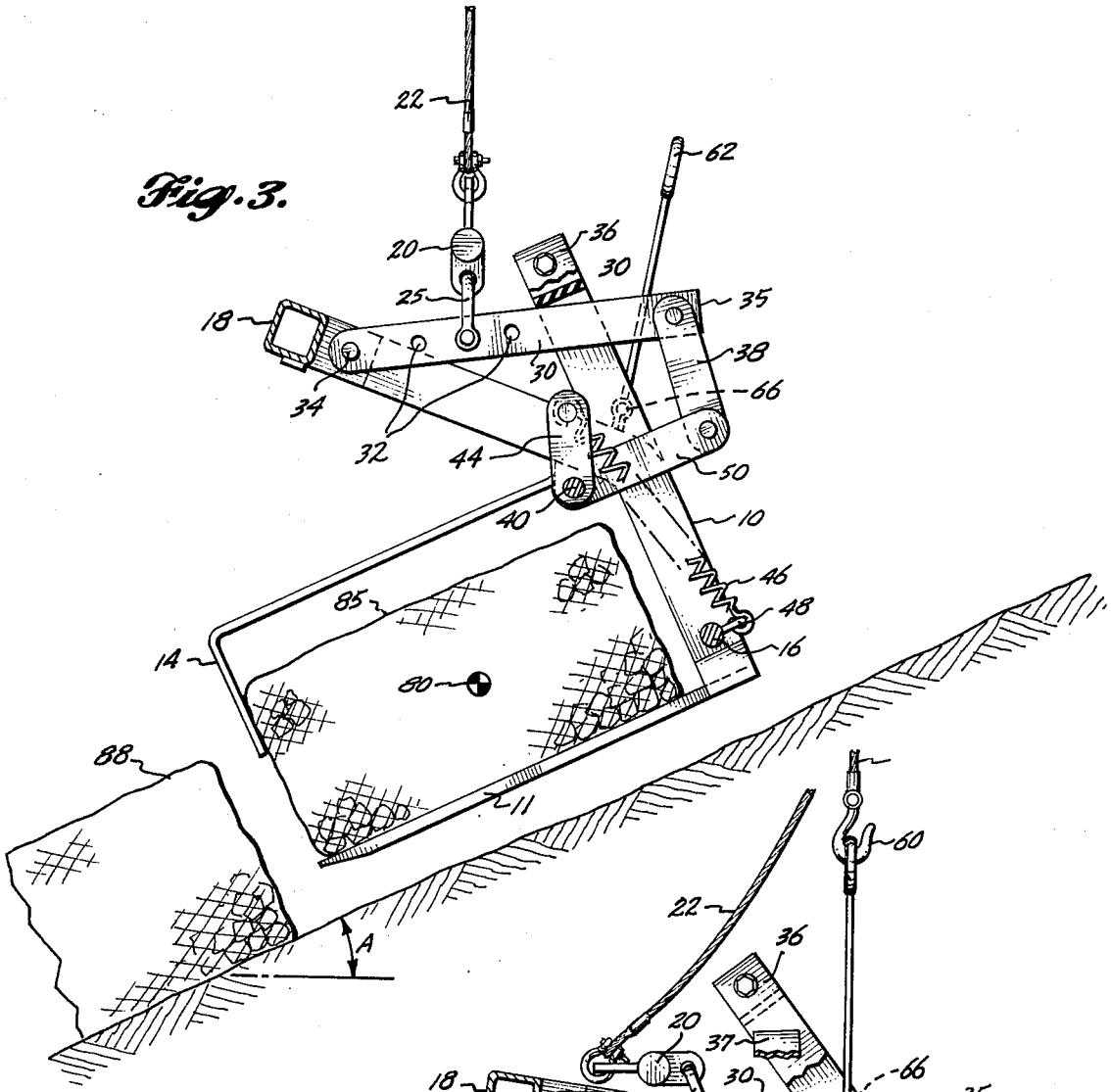
FIG. 3 is a side elevational view of the apparatus shown in FIG. 1 wherein a filled gabion basket is disposed upon the forks of the apparatus and is shown positioned adjacent the intended location for the basket in a revetment mattress.

The angle at which the loaded gabion basket lifting apparatus assumes may be adjusted by movement of the clevis 25 from the position shown to any of the other positions shown generally by numeral 32 along the length of lever arm 30. This adjustment also provides for different weights and sizes of gabion baskets so that the proper angle will be assumed upon lifting. In FIG. 3, a device carrying a gabion basket is shown in which the approximate center of gravity 80 is shown directly below the main lift line 28. Thus by positioning clevis 25*a* and 25*b* at the proper lift position, the angle assumed can be controlled.

The apparatus of this invention is equipped with a secondary lift position comprising a secondary lift ring 62 connected to straddle beams 64*a* and 64*b* which in turn engage the vertical frame members 10*b* and 10*c* at secondary lift pivots 66*a* and 66*b*. Usage of this lift location, being positioned relatively rearwardly on the apparatus, permits tilting of the apparatus and removal from beneath the gabion basket such as shown in FIG. 4. Fork tines 11 are removed from contact with the gabion basket 85. The approximate center of gravity of the apparatus when unloaded is shown at 82 causing the equipment to assume the position shown in FIG. 4.

Method of Operation

In operation, the gabion baskets as shown in FIG. 2 are first placed on a support surface 86 having a pallet or other means for elevating the gabion basket above the support surface 86. The pallet 87 has passages therethrough which permit insertion of fork tines 11 underneath the gabion basket without engaging pallet 87. Rocks or other aggregate are then placed in the gabion basket 85 until the basket is as full as desired. The top of the gabion basket is then wired shut and the entire assembly moved to a position adjacent the stream bed into which the gabions are being placed. The gabion basket lifting and emplacement apparatus is then inserted underneath the gabion basket 85 so that tines 11 are in engagement with the underside of gabion basket 85. The apparatus may be conveniently slid underneath the gabion baskets since the center of gravity of the apparatus as is shown in FIG. 2 is at the location marked 82 directly beneath the main lifting line 28. Thus the apparatus hangs suspended from line 28 with fork tines 11 positioned substantially horizontally.

When the gabion basket is located upon the tines 11, tension is applied to main lifting cable 28 and the combined wieght of the apparatus and the gabion basket overcomes the counterbalancing effect of spring 46 and hold-down arms 14*a* through 14*d* are rotated downwardly into position above the upper surface and in engagement with the outer surface of a gabion basket 85 whereby the gabion basket 85 cannot slide off tines 11. Further lifting by cable 28 rotates the apparatus and gabion basket into the position shown in FIG. 3 whereby the center of gravity 80 is positioned substantially directly below lift cable 28 and the angle of the tines with respect to the horizontal approximates the slope angle A shown in FIG. 3 of the stream bed prepared to receive the gabion baskets. The loaded apparatus is then swung into the position such as shown in FIG. 3 wherein gabion basket 85 is nestled adjacent another gabion basket 88 and dropped into position against gabion 88. When cable 28 becomes slack, spring 46 causes hold-down arms 14*a* through 14*d* to rotate upwardly out of engagement with gabion basket 85 so that the apparatus may be removed from basket 85. At that time, secondary lift cable 60 is hooked into secondary lift ring 62 and tension applied thereto so that the apparatus is lifted away from the gabion basket as shown in FIG. 4. Secondary lift cable 60 is then slackened and released from secondary lift ring 62 so that the primary lift cable 28 may again be utilized to lift and transport the apparatus back to the remaining gabion baskets awaiting emplacement.

While the inventor has described his gabion basket emplacement apparatus and method in detail with specific reference to his preferred embodiment, it is apparent that many modifications and substitutions well within the abilities of one skilled in the art may be made to this invention without departing from the scope and spirit thereof. The apparatus may assume variant forms such as, for example, including an adjustability feature so that arm pivot bearings 42*a* through 42*d* may be positioned at various locations vertically with respect to fork tines 11*a* through 11*d* whereby gabion baskets of various vertical dimensions may be accommodated. Similarly, the lengths of the fork tines 11*a* through 11*d* and the hold-down arms 14*a* through 14*d* may be varied similarly to accommodate various lengths and widths of gabion baskets. It is apparent also that simple adjustability means may be provided for varying the point of attachment of clevis 25*a* and 25*b* at any location along lever 30*a* and 30*b* respectively so that precise adjustment of the carrying attitude of the apparatus may be achieved. Other changes and modifications will become apparent to one skilled in the art.

I claim as my invention:

1. A gabion basket emplacement apparatus for placing filled gabion baskets into a revetment mattress comprising:

a frame means including a plurality of substantially vertical frame elements rigidly secured together by at least one crossmember;

a plurality of lifting tines rigidly secured to said frame;

a plurality of hold-down arms rotatably attached to said frame for engaging a filled gabion basket placed upon said tines to prevent said basket from slipping off said tines when the apparatus is lifted;

counterbalance means attached to said frame and preventing rotation of said arms whenever said apparatus is empty but permitting rotation thereof whenever a filled gabion basket rests on said tines;

means to lift said apparatus connected to said counterbalance means whereby said apparatus may be lifted with said arms in an open position and said tines substantialy horizontal whenever said apparatus is not loaded and with said arms in a closed, basket engaging position whenever said apparatus is loaded with a filled gabion basket, and secondary lift means attached directly to said frame rearwardly of said means to lift whereby said apparatus may be withdrawn easily from beneath said gabion basket.

2. The apparatus of claim 1 wherein said tines are angled with respect to the horizontal whenever said apparatus loaded with a filled gabion basket is lifted by said means to lift said apparatus.

3. The apparatus of claim 1 wherein said counter-balance means includes a tension spring extending between said frame and said hold-down means biasing said hold-down means in an open position.

4. The apparatus of claim 1 wherein said hold-down means is adjustable vertically to accommodate gabion baskets of various heights.

5. The apparatus of claim 1 wherein said means to lift said apparatus is connected to said counterbalance means at a location adjustable to accomodate variable sizes of gabion baskets and to vary the attitude assumed by the loaded apparatus when lifted.

6. The apparatus of claim 1 wherein said tines are angled with respect to the horizontal at an angle substantially equivalent to the slope of the revetment mattress being installed.

7. A method of forming revetment mattresses from filled gabion baskets comprising the steps of:

placing an empty gabion basket on a pallet having transverse, upwardly opening slots therein;

filling said gabion basket with rocks;

placing the tines of a lifting apparatus beneath said gabion basket in said upwardly opening slots in said pallet said lifting apparatus having a primary lift line actuated means to prevent said gabion basket from sliding off said tines;

raising said lifting apparatus whereby said primary lift line actuated means engages said gabion basket and said tines assume an attitude corresponding to the slope of said revetment mattress;

placing said gabion basket adjacent other gabion baskets in said revetment mattress;

slackening said primary lift line whereby said primary lift line actuated means is disengaged from said gabion basket;

engaging a secondary lift line means at a secondary lift point disposed rearwardly from the point of connection of said lift line whereby the rearwardly disposed portion of said lifting apparatus is rotated upwardly and lifted away from said gabion basket; and withdrawing said lifting apparatus from beneath said gabion basket.

8. The method of claim 7 wherein said apparatus is lifted by a single line lift device.

9. The method of claim 7 and the further step of connecting said gabion basket to adjacent gabion baskets in said revetment mattress.

10. A gabion basket emplacement device for lifting and emplacing a filled gabion basket into a revetment mattress comprising:

a frame means;

a plurality of lifting tines extending forwardly from said frame means;

a gabion basket hold-down means rotatably attached to said frame means and extending forwardly therefrom above said tines, said hold-down means rotatable from a first, gabion gasket engaging position to a second open position and being biased toward said second position; and linkage means for rotating said hold-down means from said first position to said second position and including a first lift point located on said linkage means whereby said emplacement device is lifted with said hold-down means in said first position whenever a filled gabion basket is placed on said tines and in said second position when no gabion gasket is on said tines, said linakge means comprising:

a lift beam pivotally mounted at a first end thereof on said frame and having said first lift point thereon;

an arm pivot beam rotatively attached to said frame and carrying said gabion basket hold-down means whereby rotation of said arm pivot beam rotates said hold-down means and;

a link extending between said arm pivot and said lift beam whereby lifting forces applied to said first lift point causes said lift beam to pivot thereby rotating said hold-down means into contact with said gabion basket.

11. The apparatus of claim 10 wherein said first lift point is located so that said tines assume an angle with respect to the horizontal when said apparatus is lifted with a filled gabion basket thereon.

12. The apparatus of claim 10 and secondary lift means positioned on said frame rearwardly from said first lift point whereby said apparatus may be lifted and said tines slid rearwardly from beneath a gabion basket.

13. The apparatus of claim 10 wherein said hold-down means is biased toward said second, open position by a tension spring extending from said frame to a spring shackle means rigidly attached to said arm pivot beam whereby said arm pivot beam is rotatively urged counter to the rotation caused by said lifting forces.

14. The apparatus of claim 10 whereby said hold-down means is vertically adjustable to accommodate gabion gaskets of various heights.

15. The apparatus of claim 10 wherein said accommodate lift point is adjustable along said lift beam to accomodate various sizes of gabion baskets and to vary the attitude assumed by the apparatus when lifted.

* * * * *

UNITED STATES PATENT AND TRADEMARK OFFICE

CERTIFICATE OF CORRECTION

PATENT NO. : 4,000,923

DATED : January 4, 1977

INVENTOR(S) : Matt Baldwin

It is certified that error appears in the above–identified patent and that said Letters Patent are hereby corrected as shown below:

Column 7, line 11, delete "gasket" and insert --basket--.

Column 7, line 22, delete "gasket" and insert --basket--.

Column 8, line 24, delete "gasket" and insert --basket--.

Signed and Sealed this

Tenth Day of May 1977

[SEAL]

*Attest:*

RUTH C. MASON
*Attesting Officer*

C. MARSHALL DANN
*Commissioner of Patents and Trademarks*